US011673740B2

(12) United States Patent
Leon

(10) Patent No.: US 11,673,740 B2
(45) Date of Patent: Jun. 13, 2023

(54) WASTE CONTAINER AND WASTE LINER SYSTEM

(71) Applicant: Integrated Service Partners IP, LLC, Miami, FL (US)

(72) Inventor: Gustavo Leon, Miami, FL (US)

(73) Assignee: Integrated Service Partners IP, LLC, Miami, FL (US)

( * ) Notice: Subject to any disclaimer, the term of this patent is extended or adjusted under 35 U.S.C. 154(b) by 88 days.

(21) Appl. No.: 15/892,055

(22) Filed: Feb. 8, 2018

(65) Prior Publication Data

US 2018/0222672 A1 Aug. 9, 2018

Related U.S. Application Data

(60) Provisional application No. 62/456,325, filed on Feb. 8, 2017.

(51) Int. Cl.

| | |
|---|---|
| ***B65F 1/06*** | (2006.01) |
| ***B65F 1/14*** | (2006.01) |
| ***B65F 1/16*** | (2006.01) |

(52) U.S. Cl.

CPC ..... *B65F 1/14* (2013.01); *B65F 1/062* (2013.01); *B65F 1/1638* (2013.01); *B65F 1/1473* (2013.01); *B65F 1/163* (2013.01); *B65F 1/1623* (2013.01); *B65F 2210/129* (2013.01); *B65F 2210/168* (2013.01); *B65F 2210/184* (2013.01)

(58) Field of Classification Search

CPC ..... B65F 1/062; B65F 1/067; B65F 1/065

See application file for complete search history.

(56) References Cited

U.S. PATENT DOCUMENTS

| | | | |
|---|---|---|---|
| 2,281,630 | A | 5/1942 | Southard |
| 3,300,082 | A | 1/1967 | Patterson |
| 3,451,453 | A | 6/1969 | Heck |
| 3,481,112 | A | 12/1969 | Bourgeois |
| 3,800,503 | A | 4/1974 | Maki |
| 4,037,778 | A | 7/1977 | Boyle |
| 4,349,123 | A | 9/1982 | Yang |
| 4,364,490 | A | 12/1982 | Lang |
| 4,721,226 | A | 1/1988 | Yurko |
| 4,798,363 | A | 1/1989 | Cortesi |
| 4,850,507 | A | 7/1989 | Lemongelli |
| 4,869,391 | A | 9/1989 | Farrington |
| 4,955,505 | A | 9/1990 | Battaglia |
| 5,115,935 | A | 5/1992 | Lemongelli |
| 5,405,041 | A | 4/1995 | Van Brackle |
| 6,814,249 | B2 | 11/2004 | Lin |
| 6,866,070 | B2 | 3/2005 | King |
| 7,516,865 | B1 | 4/2009 | Pierre |

(Continued)

*Primary Examiner* — Stephen J Castellano

(74) *Attorney, Agent, or Firm* — McDonald Hopkins LLC

(57) ABSTRACT

A container assembly including a body portion with a front wall, a rear wall, and lateral side walls connecting the front wall and the rear wall. The body portion may be divided by a horizontal partition into an upper waste portion above the partition and a lower weight sensor portion below the partition, wherein the weight sensor portion includes a weight sensor. A container assembly may include an opening disposed on the rear wall of the body portion and a bag dispenser positioned near the opening and disposed on an interior surface of the rear wall, wherein the opening provides access from the bag dispenser to an interior space of the body portion.

3 Claims, 16 Drawing Sheets

(56) References Cited

U.S. PATENT DOCUMENTS

| | | | | |
|---|---|---|---|---|
| 7,878,359 | B1 | 2/2011 | Ko | |
| 8,490,813 | B2 | 7/2013 | Leon | |
| 2001/0052522 | A1* | 12/2001 | Forest | B65D 25/14<br>220/495.07 |
| 2006/0081632 | A1 | 4/2006 | Shieh | |
| 2006/0137619 | A1 | 6/2006 | Man | |
| 2006/0210200 | A1 | 9/2006 | Mikanikian | |
| 2007/0272715 | A1 | 11/2007 | Sassoon | |
| 2008/0023505 | A1 | 1/2008 | Sassoon | |
| 2008/0175751 | A1 | 7/2008 | Sun | |
| 2010/0264168 | A1 | 10/2010 | Larabee | |
| 2011/0073598 | A1 | 3/2011 | Liscio | |
| 2011/0303664 | A1 | 12/2011 | Nichols | |
| 2012/0234836 | A1* | 9/2012 | Barrett | B65F 1/062<br>220/495.07 |

* cited by examiner

WASTE CONTAINER AND WASTE LINER SYSTEM

CROSS-REFERENCE TO RELATED APPLICATIONS

This application claims the benefit of U.S. Provisional Patent Application No. 62/456,325 entitled "WASTE CONTAINER AND WASTE LINER SYSTEM" filed Feb. 8, 2017, which is hereby incorporated by reference in its entirety. This application is also related to U.S. Pat. No. 8,490,813 entitled "WASTE CONTAINER AND SEQUENTIAL LINER DEPLOYMENT METHOD" filed on Aug. 19, 2009 which claims priority to U.S. Provisional Patent Application No. 61/207,772 entitled "WASTE CONTAINER AND SEQUENTIAL LINER DEPLOYMENT METHOD" flied Feb. 17, 2009, both of which are hereby incorporated by reference in their entireties.

FIELD OF THE DISCLOSURE

The present invention relates generally to the field of waste containment and disposal.

BACKGROUND

There have long been liners in the form of flexible plastic bags for lining waste containers so that waste can be easily removed by removal of the filled liner, while the interior of the container remains reasonably clean. There are, however, several problems with current methods and devices for lining waste containers. For example, boxes of liners are not always at hand and must be found and retrieved; the liners must be pulled out of a separate box, taken to the waste container, inserted and cuffed over the rim; and a significant amount of time and energy is expended in expanding the liner outside of the container and subsequently securing the liner to rim of the container.

It is thus an object of the present invention to provide a method and apparatus whereby liners are incorporated into a container such that the liners can be sequentially deployed directly within the container with a single pull, and then simply cuffed over the container rim.

It is another object of the present invention to provide a waste container having an accessible compartment whereby a box or package containing a plurality of interconnected waste liners can be easily loaded into a tray within the compartment for deployment within the waste container.

It is another object of the present invention to provide a sensor within the waste container that monitors the weight and/or volume of the waste that is contained within the waste liner, and notifies the user when the waste liner must be removed and replaced based on the volume and/or weight of the waste contained within the liner.

It is another object of the present invention to provide a fastener around the top portion of the waste liner that cinches the of the waste liner when the waste liner must be removed from the container.

Still another object of the present invention is to provide a waste container that automatically discharges an antiseptic or fragrant spray each time a new liner bag is deployed inside of the waste container.

SUMMARY

In an embodiment, the present technology discloses a container assembly including a body portion with a front wall, a rear wall, and lateral side walls connecting the front wall and the rear wall. The body portion may be divided by a horizontal partition into an upper waste portion above the partition and a lower weight sensor portion below the partition, wherein the weight sensor portion includes a weight sensor. A container assembly may include an opening disposed on the rear wall of the body portion and a bag dispenser positioned near the opening and disposed on an interior surface of the rear wall, wherein the opening provides access from the bag dispenser to an interior space of the body portion.

In an embodiment, the waste container liner has an integrated fastener near the upper edge of the liner. When the liner is removed from the container, the fastener can be elongated and wrapped around the upper perimeter of the waste container liner for disposal.

In an embodiment, the waste container lid is further comprised of a spring-activated button that causes the lid to open when the button is engaged by the user.

In an embodiment, the waste container further comprises a lower chamber partitioned from the waste liner compartment by a false bottom. The lower chamber is sized to contain a sensor or scale that measures the weight and/or volume of waste within a liner that has been deployed within the waste liner compartment. Preferably, when the waste within the liner compartment reaches a certain weight and/or volume, the sensor notifies the user that the waste liner must be replaced by sending a signal to a receiver located near the upper rim of the waste container. The receiver may use an LED indicator to signal that the waste liner is full, or alternatively, by emitting a sound frequency. The weight sensor may be accessed such as by removing a container bottom wall secured to one or more of the container side walls, or opening a door located on one or more of the container side walls.

In an embodiment of the present invention, every time a new sequentially linked liner bag is pulled up to take the place of the previously filled liner bag, an electric motor activates a spray discharge into the waste chamber. The discharge can be scented or unscented, and can also have antiseptic qualities such as a germ or bacteria killing agent. Preferably, this spray discharge system is located on the lower rim of the waste container lid.

DETAILED DESCRIPTION

Figure 1A:
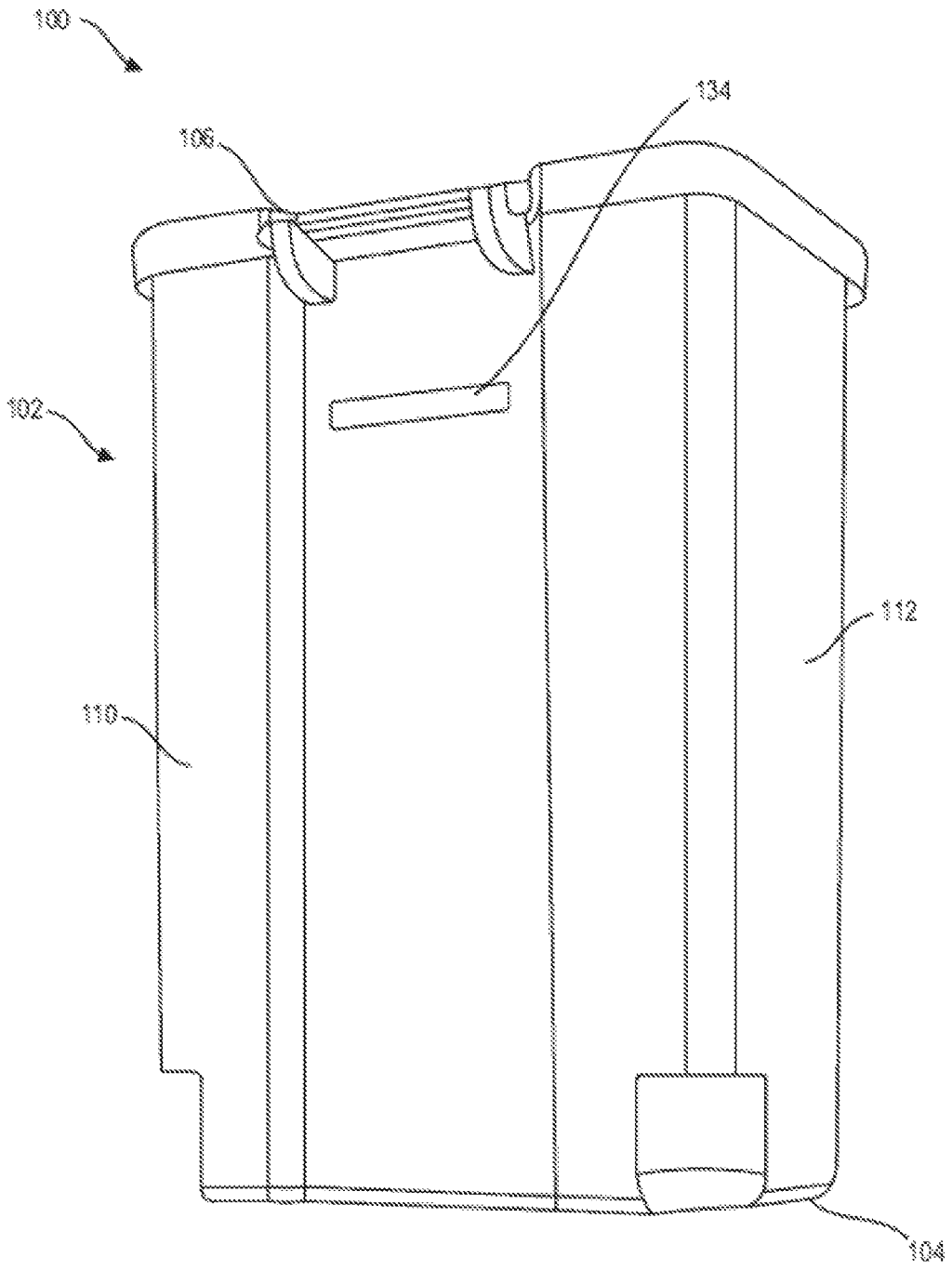
FIGS. 1A-1D depict a perspective, front, side and back view of the container assembly with the liner chamber shown on the back wall of the container.
Figure 1D:
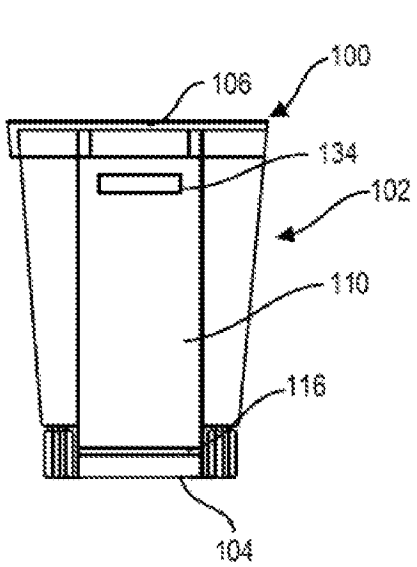
Figure 1C:
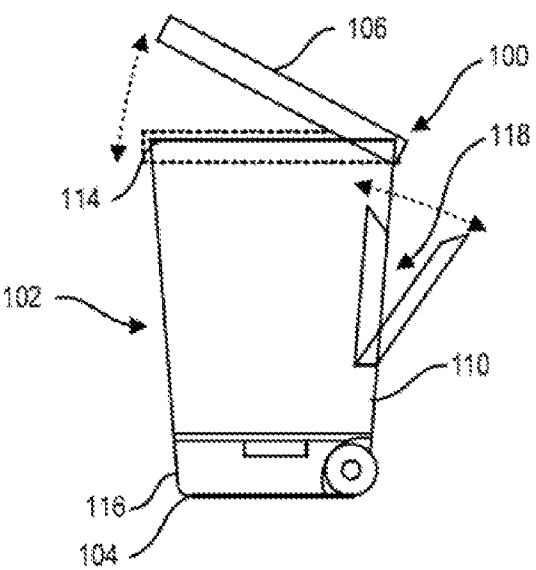
Figure 1B:
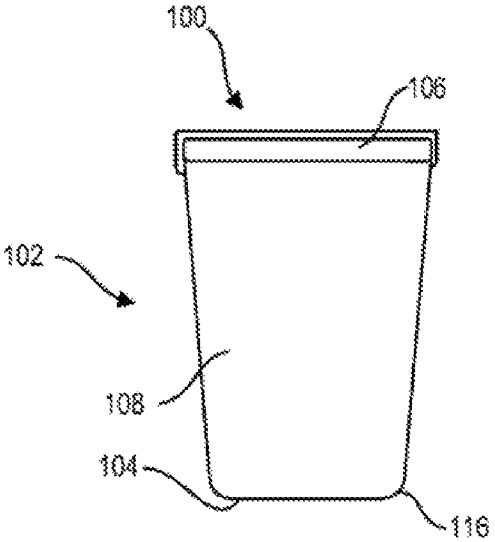

Reference will now be made in detail to embodiments of the present disclosure, examples of which are illustrated in the accompanying drawings. It is to be understood that other embodiments may be utilized and structural and functional changes may be made without departing from the respective scope of the disclosure. Moreover, features of the various embodiments may be combined or altered without departing from the scope of the disclosure. As such, the following description is presented by way of illustration only and should not limit in any way the various alternatives and modifications that may be made to the illustrated embodiments and still be within the spirit and scope of the disclosure.

FIG. 1 illustrates a container assembly 100 having a body portion 102, a base 104, and a lid 106 movable with respect to the body portion 102. The base 104 may support the container assembly 100 in a stable, resting position when the container assembly 100 rests on a surface such as a floor or the ground, and the body portion 102 may extend upward from the base 104. In an embodiment, the base 104 can be formed of a plastic or metal material. The base 104 may include a skirt or foundation that extends generally all of the way around the container 100, from the bottom of the body portion 102 to its resting surface, e.g., a floor. The base 104 may include wheels for ease of contain movement. The container assembly 100 may include a mechanism to move the lid 106 from a closed to an open position, such as a pedal-operated mechanism or a sensor-activated mechanism.

The body portion 102 may include a front wall 108, a rear wall 110, and parallel sidewalls 112 connecting the front wall 108 and the rear wall 110. The lid 106 may rest on top of the body portion 102. The lid 106 may actively engage with the body portion 102, e.g., by a fastener, magnets, latch, snap, or similar feature. The lid 106 may be pivotably connected to the body portion 102. If the lid 106 is pivotably connected (e.g., rotatably, hingedly, or otherwise) to the body portion 102 by a biasing member (e.g., a leaf spring, torsion spring, tension spring, compression spring, or otherwise), the rear wall 110 may be on the same side as the pivotable connection between the lid 106 and the body portion 102. In an embodiment, the lid 106 may feature two or more doors that are pivotably connected to the body portion 102, and may include two or more pivotable connections on the body portion 102, e.g., one on the front wall 108 and one on the rear wall 110, or one on each of the sidewalls 112. The lid 106 may be any appropriate shape, including, but not limited to, flat, angular or dome-shaped. In an embodiment, the lid 106 may have the same cross-sectional geometric configuration as the body portion 102, such that the lid 106 entirely covers the opening of the body portion 102 when in a closed position, i.e., engaged with the body portion 102, thereby keeping any contents (e.g., waste) of the container 100, including but not limited to garbage, from being visible. The lid 106 may also prevent or decrease the scent of the contents of the container 100 from being detectable. FIG. 1 shows the lid in a closed position. When the lid 106 is disengaged from the body portion 102, the interior of the body portion 102 is exposed, such that new contents may be added to the container 100, the contents may be emptied, a liner may be changed, and the like.

Figure 12:
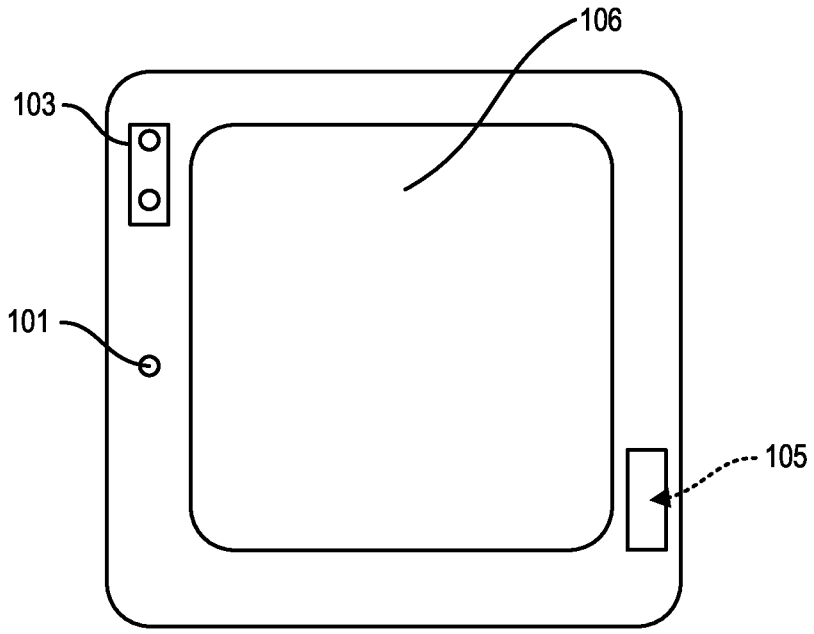
FIG. 12 depicts a plan view of the closed container assembly of the present technology.

In an embodiment, the lid 106 may include a button 101 (spring-activated, motion-activated, or the like) that causes the lid 106 to open when the button 101 is engaged by the user, as shown in FIG. 12.

The body portion 102 may include an upper edge 114 and a lower edge 116. The lid 106 may be disposed along or near the upper edge 114 of the body portion 102, and the base 104 may be disposed along or near the lower edge 116 of the body portion 102.

The body portion 102 may be any shape, including, but not limited to, generally square, rectangular, cylindrical, triangular, or any other appropriate shape. The body portion 102 may be any appropriate size dimensions. Any of the container assembly 100 components can be formed from one or more different materials, such as plastic or metal (e.g., stainless steel or aluminum,), or any other appropriate material. The materials may be of any thickness. The body portion 102 may be any color or may be multi-colored. The body portion 102 may be patterned or it may be solid colored.

The body portion 102 may also include a bag dispenser 118 disposed on one of the walls, i.e., the rear wall 110, the front wall 108 or a sidewall 112. The bag dispenser 118 may be configured to receive and to dispense one or more bags 124 (e.g., a package of bags 126), but the term "bag dispenser" does not require the presence of bags therein at all times.

The dispenser 118 may be part of or secured to the interior surface of the rear wall 110 of the body portion 102. In an embodiment, the dispenser 118 may be part of or disposed on the interior surface of the front wall 108 or on one of the sidewalls 112. Such interior configurations can maintain an exterior volume of the container assembly 100. Positioning the bag dispenser 118 on a front, side, or rear wall of the body portion 102 can avoid a protrusion on the exterior surface of the body portion 102 without increasing an overall height of the container assembly 100. In an embodiment, positioning the bag dispenser 118 interior to the rear wall 110 leaves the exterior surface of the rear wall 110 generally smooth, generally planar (e.g., positioned generally vertically), generally continuous, and/or generally unobstructed (e.g., free of any substantial bumps, protrusions, recesses, and/or other discontinuous features). This can avoid creating an unevenly shaped container 100 that may be difficult to position against a wall in the external environment. Additionally, positioning the bag dispenser 118 on an interior surface of a wall of the container assembly 100 keeps the bag dispenser 118 out of plain sight and avoids creating an obstruction to people or animals walking past the container assembly 100.

In an embodiment, the dispenser 118 may be part of or secured to the exterior surface of the rear wall 110 of the body portion 102. In an embodiment, the dispenser 118 may be part of or disposed on the exterior of the front wall 108 or on one of the sidewalls 112. Such exterior configurations can maintain an interior volume of the container assembly 100. Positioning the bag dispenser 118 on a front, side, or rear wall of the body portion 102 can avoid a reduction in a depth of the interior volume without increasing an overall height of the container assembly 100. In an embodiment, positioning the bag dispenser 118 exterior to the rear wall 110 leaves the interior surface of the rear wall 110 generally smooth, generally planar (e.g., positioned generally vertically), generally continuous, and/or generally unobstructed (e.g., free of any substantial bumps, protrusions, recesses, and/or other discontinuous features). This can avoid a reduction of the interior volume of the body portion 102 and/or reduce the chance that a bag liner disposed within the container assembly too will be torn by the bag dispenser 118. Additionally, positioning the bag dispenser 118 on a rear wall 110 of the container assembly 100 keeps the bag dispenser 118 out of plain sight when the rear wall 110 is positioned against a wall in the surrounding environment (e.g., wall of a house, building, or other structure) and avoids creating an obstruction to people or animals walking past the container assembly 100.

In an embodiment, the bag dispenser 118 may include a housing 128 with an interior volume 130 in which one or more bags 124 or a package of bags 126 can be disposed. In an embodiment, at least a portion of the bag dispenser 118 may be integrally formed with the body portion 102, such that a wall portion of the body portion 102 forms a part of the bag dispenser 118.

The bag dispenser 118 may include a dispenser tray 132 removably or movably (e.g., rotatably, hingedly, magnetic, by fastener or otherwise) connected to the housing 128, by a biasing member (e.g., a leaf spring, torsion spring, tension spring, compression spring, or otherwise). The dispenser lid 120 can include a user-engagement portion 122 (e.g., groove, handle, switch, snap, sensor or otherwise), such that the dispenser lid 120 may be moved between an open position, as shown in FIG. 2, and a closed position, as shown in FIG. 1A.

Figure 2:
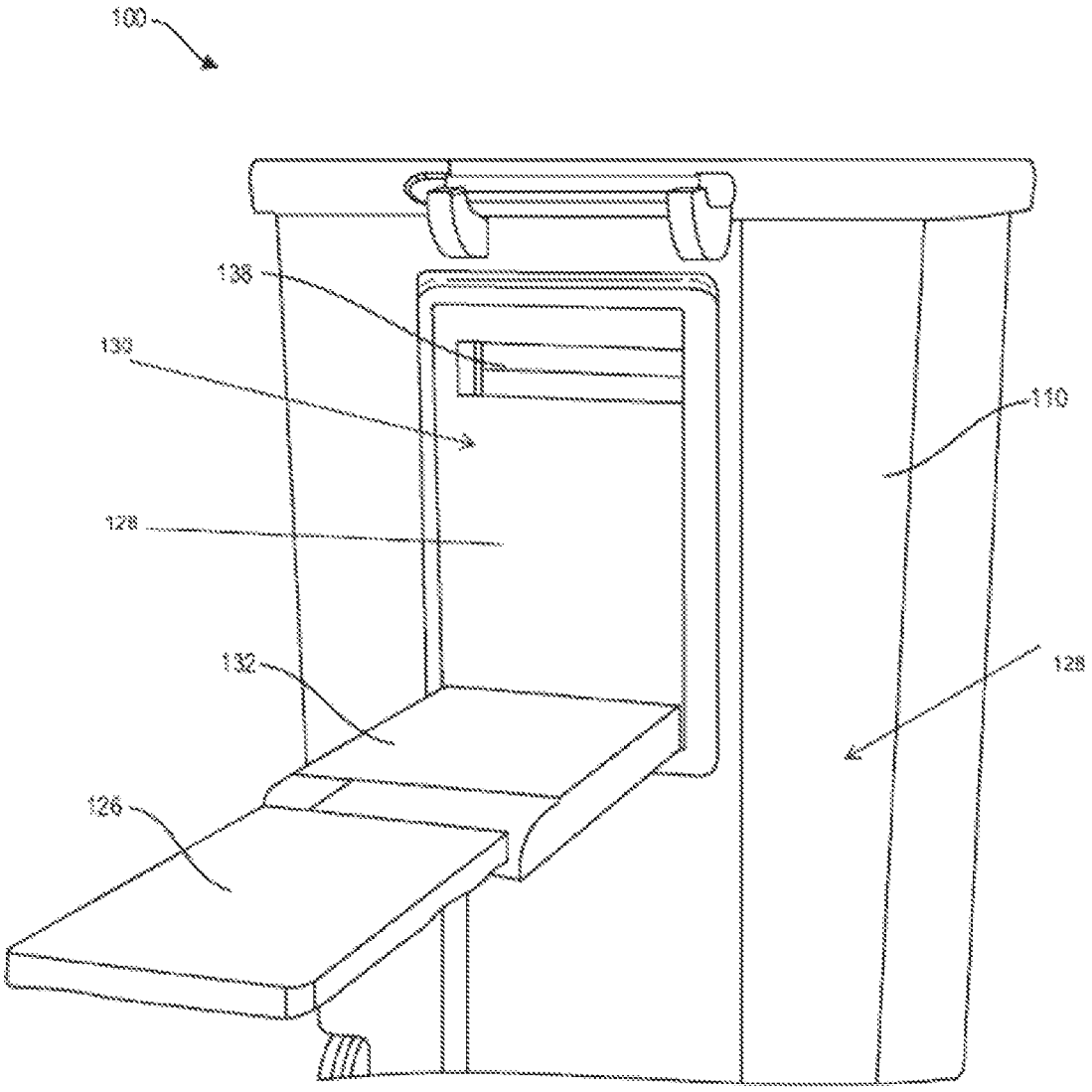
FIG. 2 depicts a rear view of the container with a hinged liner tray in an open position for insertion of a waste liner box or cartridge.

When the dispenser tray 132 is in an open position as shown in FIG. 2, a user may add a bag 124 or package of bags 126. When the dispenser tray 132 is in a closed position as shown in FIG. 1A, the interior volume 130 is created and secured within the interior of the body portion 102.

In an embodiment, as shown in FIG. 1A, the housing 128 can have an opening 134 (e.g., channel, groove, indentation, or likewise) near the user-grip portion so that the user can easily grip the user-engagement portion 112. Further, the housing 128 can include a support member that can engage the dispenser lid 120 when the dispenser lid 120 is in the closed position. For example, the dispenser lid 120 can form a snap connection with a groove 138 of the support member 136.

The bag dispenser 118 may be provided at any appropriate location on the body portion 102. For example, the bag dispenser 118 may be positioned at and/or near the top of the container assembly 100, such that a user may more easily access the bag dispenser 118 and the dispenser tray 132 without having to bend over. This allows a user to easily replenish bags 124 from the outside of the container assembly 100, without being required to remove a bag 124 inside of the container assembly 100.

Figure 3:
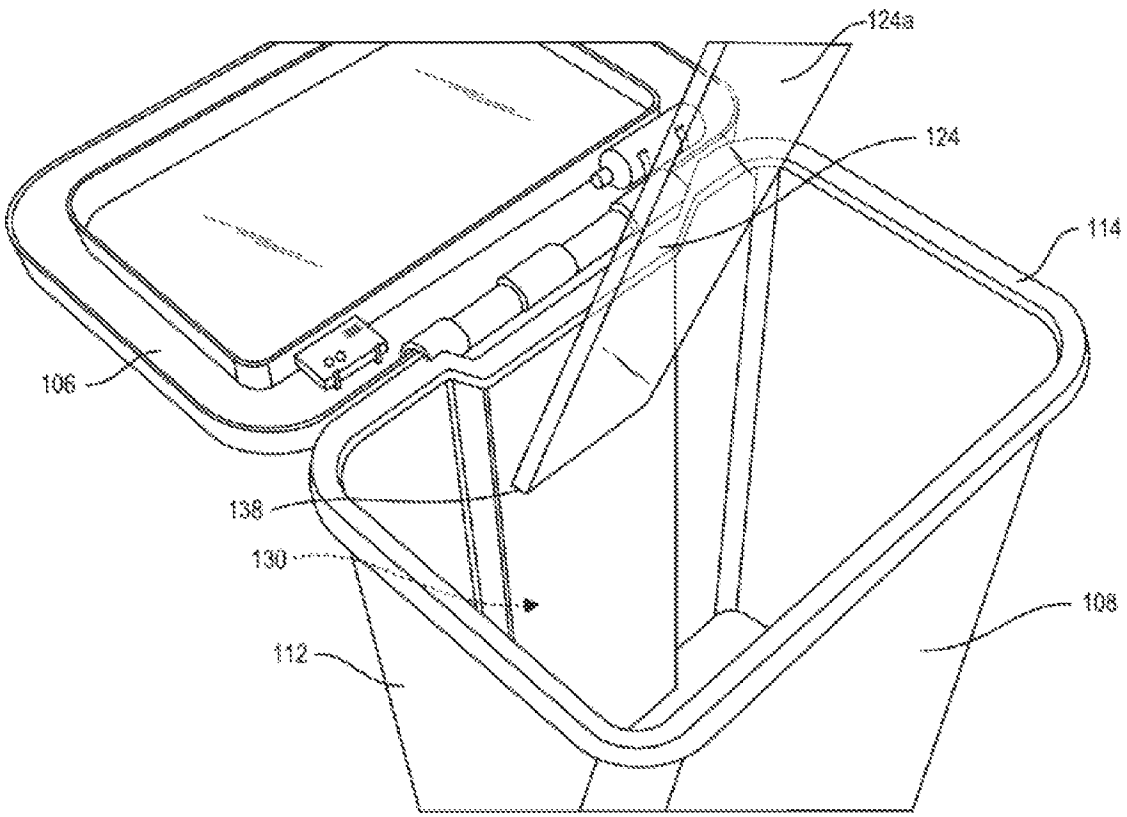
FIG. 3 depicts the interior of the waste container with a liner being pulled through the liner passing port.
Figure 4:
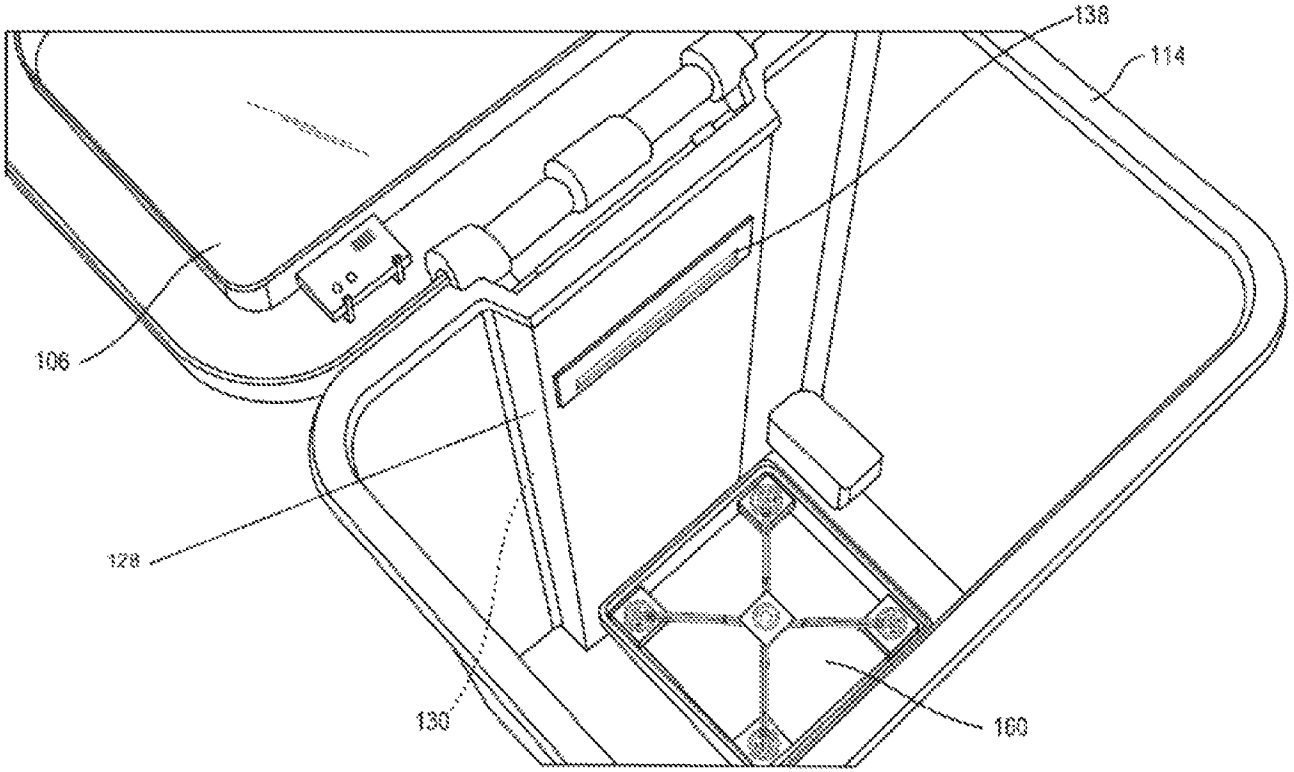
FIG. 4 depicts the interior of the waste container with the weight sensor position at the bottom of the container.
Figure 5:
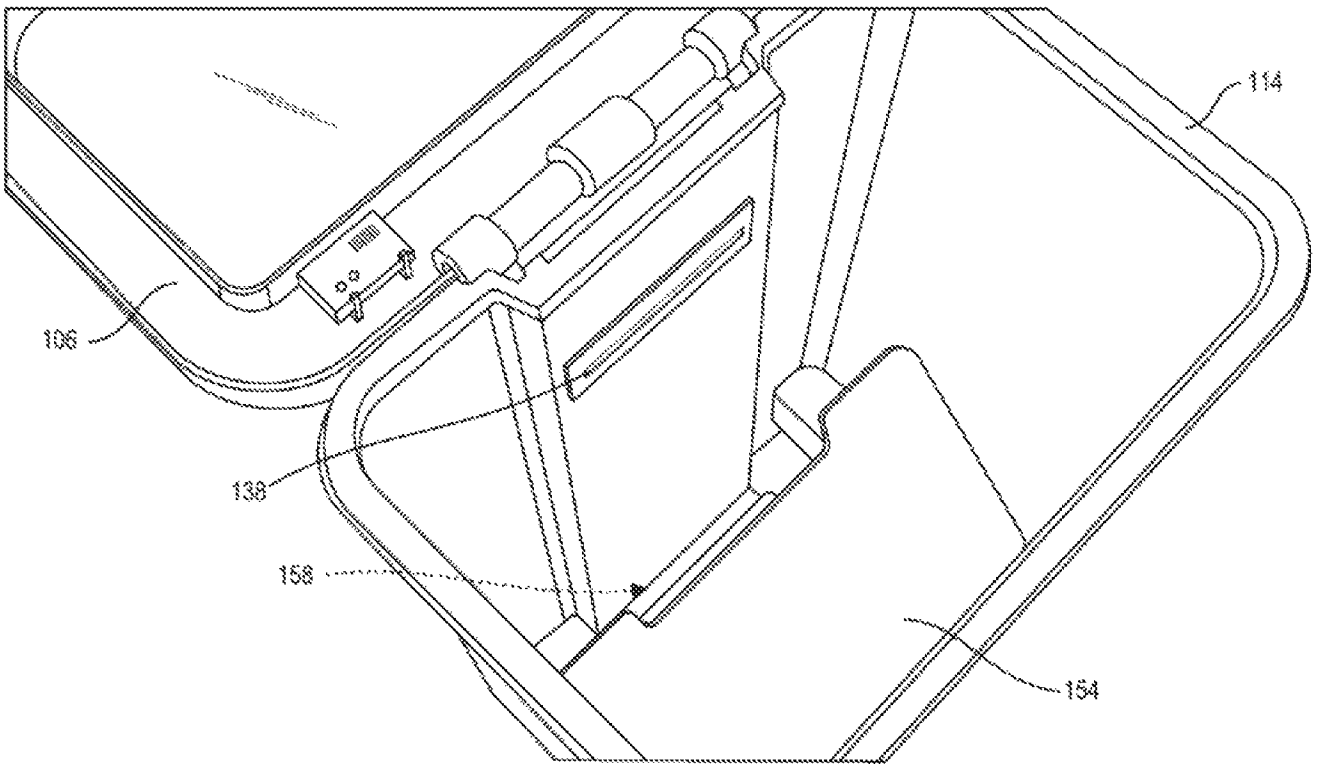
FIG. 5 depicts the interior of the waste container with a false bottom positioned over the weight sensor.
Figure 6:
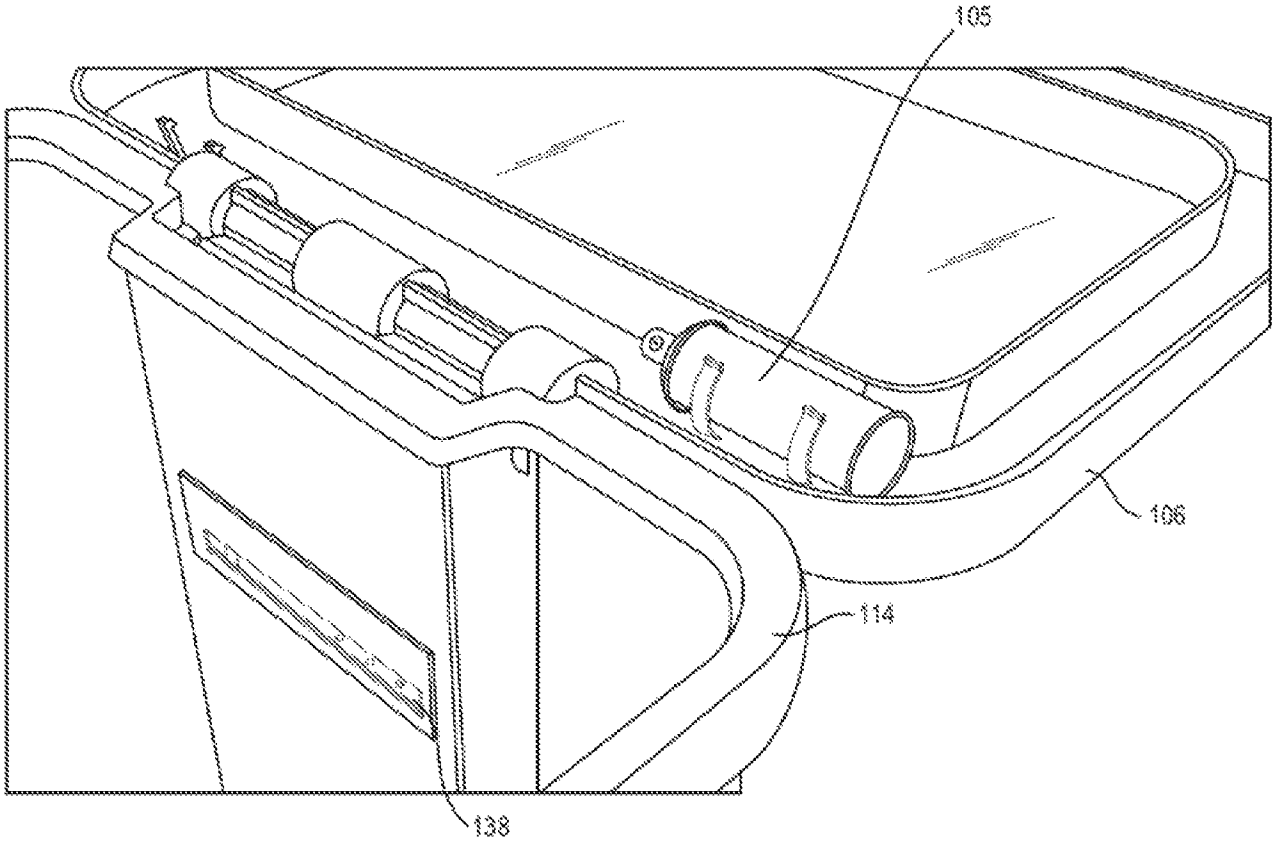
FIG. 6 depicts the lid of the waste container with a spray discharge container located along the edge of the inner side of the lid.
Figure 7:
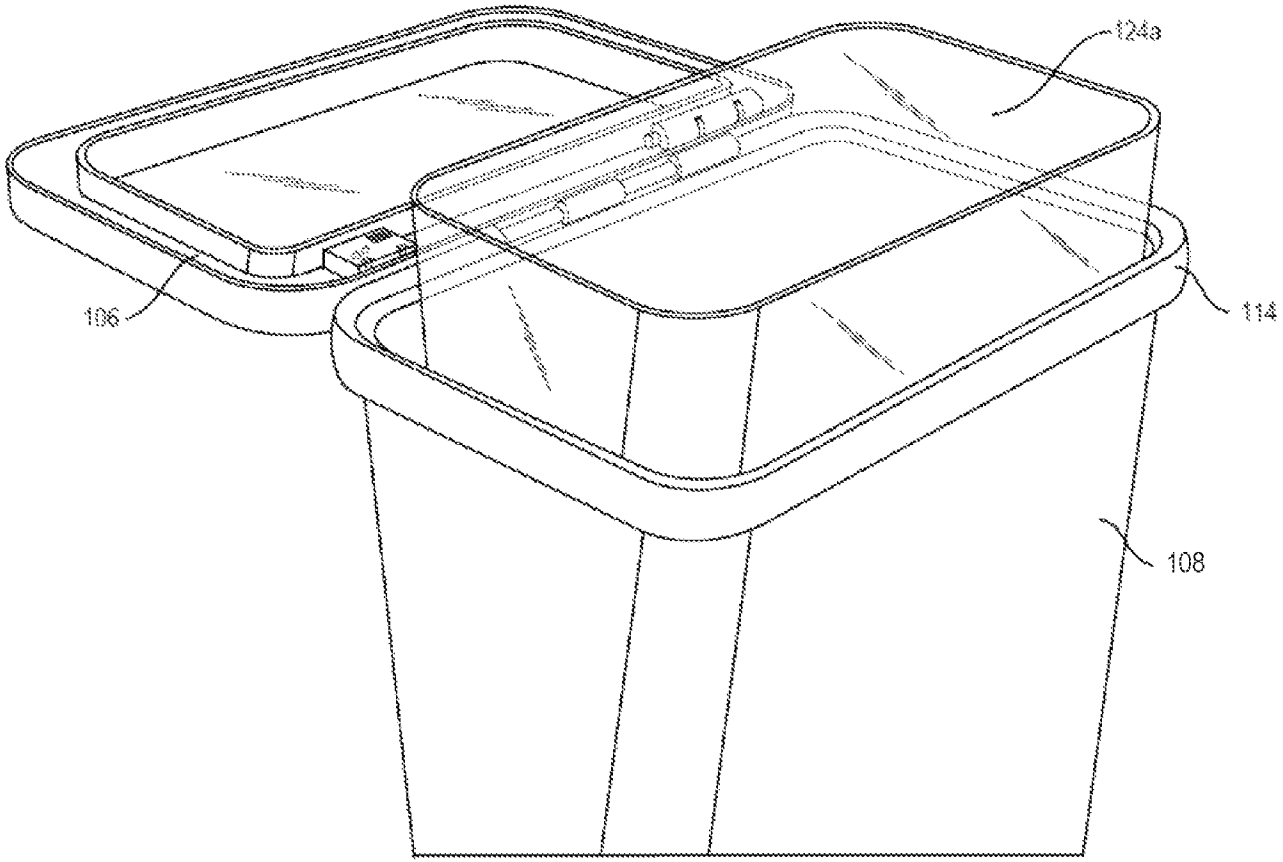
FIG. 7 depicts the waste liner being deployed from the passing port and being secured along the upper perimeter of the waste container.
Figure 8:
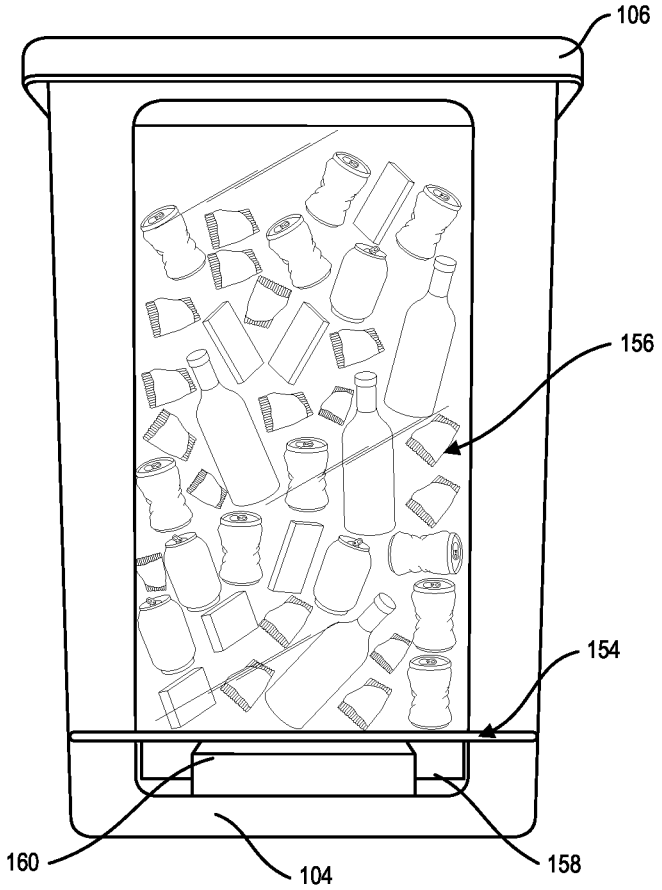
FIG. 8 depicts the waste container with a liner filled with waste and line demarcating the separation of the waste container chamber and sensor chamber.
Figure 9:
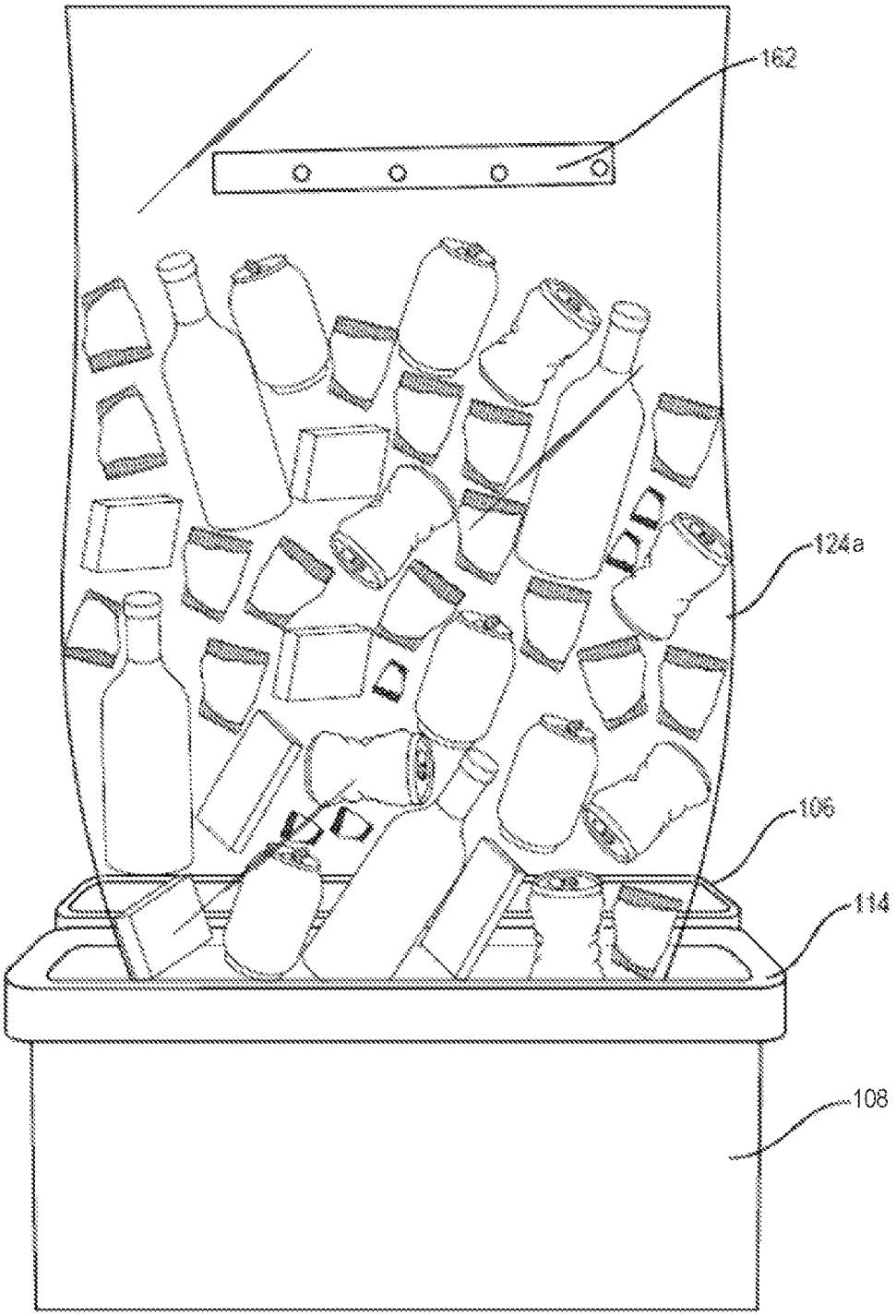
FIG. 9 depicts the filled waste container liner being removed from the waste container with an integrated fastener for cinching the top of the waste filled liner.
Figure 10:
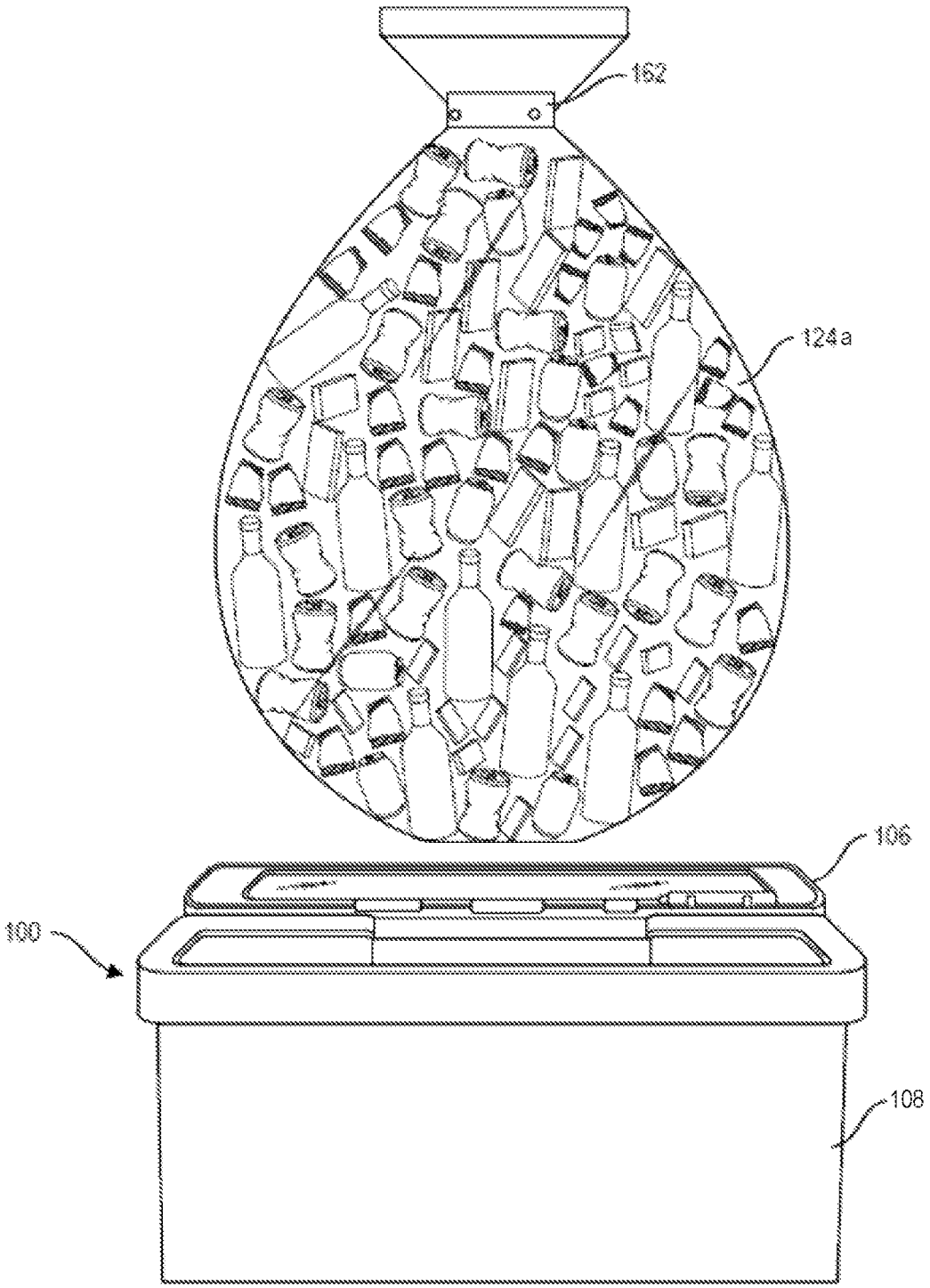
FIG. 10 depicts the filled waste container liner after the fastener has been cinched around the liner's upper perimeter.
Figure 11A:
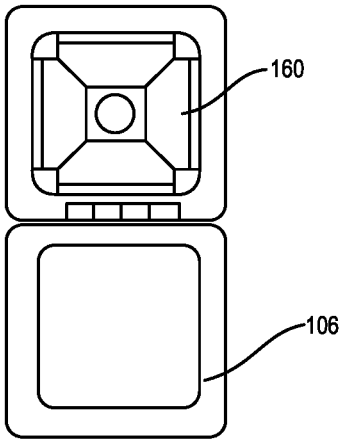
FIGS. 11A-11C depict a plan review of the open container assembly without the partition, a plan review of the weight sensor, a side view of the weight sensor.
Figure 11B:
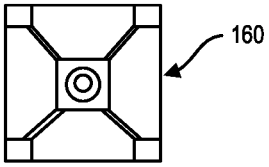
Figure 11C:
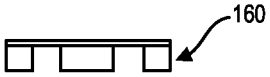

As shown in FIG. 3, an opening 138 may be formed in the interior wall 140 of the bag dispenser 118 and/or the rear wall 106 of the body portion 102. The opening 138 can provide access from an interior volume 124 of the bag dispenser 118, through the rear wall 106, to an interior space of the body portion 102.

The opening 138 may provide a user with easy access to the bags 124. For example, when the bag dispenser 118 is positioned on the rear wall 106 of the body portion 102 and the rear wall 106 is positioned against a wall (e.g., a wall of a house, building, or other structure), user can, from within the container, extract a bag liner from the dispenser 114 via the opening 138. This can avoid the need to move the container assembly 100, such as if the opening was disposed along a rear surface of the bag dispenser 118. The opening 138 may be any appropriate shape, including, but not limited to, a horizontal slit, a vertical slit, a round aperture, a rectangular aperture or the like, so long as a bag 124 may fit through the opening 138.

The bag dispenser 118 and the opening 138 may be positioned at any appropriate location on the body portion 102. In an embodiment, the opening 138 can be formed in the upper half or upper quarter of the rear wall 106. This may position the bags at an easily accessible location. In this embodiment, a user may easily access a bag 124 without having to bend over and/or extend their arm too far into the container assembly 100.

During use, the bags 124 may be provided in a package 126. The package 126 may include a sequential plurality of bags 124, each bag 124 being linked to the next bag 124 in the sequence, and whereby a first bag 124*a* in the sequence extends at least partially through the opening 138 to ready the container assembly 100 for use. Although sequentially linked bags 124 are discussed, the container assembly 100 will also work with conventional bags that are not sequentially linked to one another.

Figure 13A:
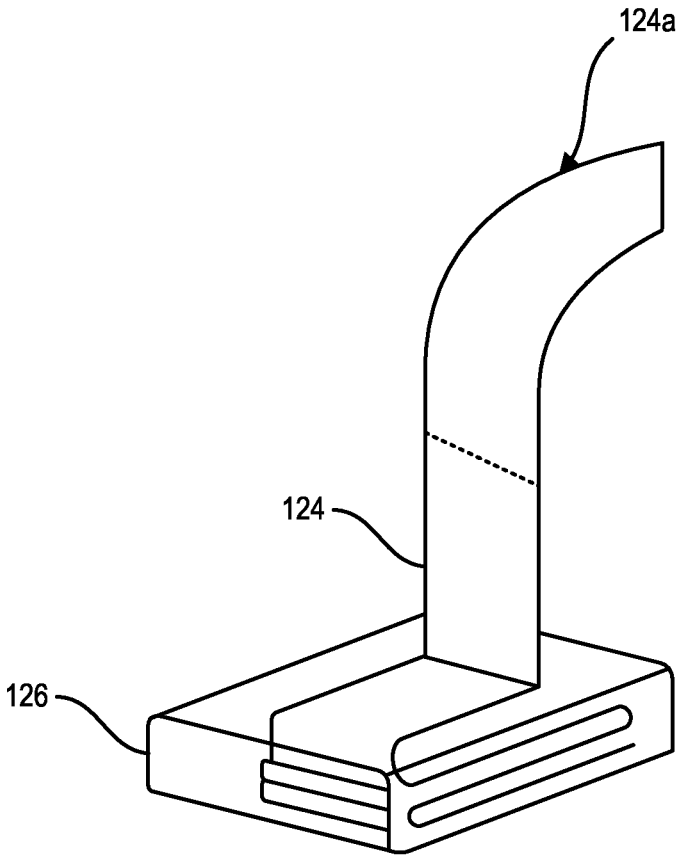
FIGS. 13A-13B depict a perspective view of the bag package and a side view of the stacked bags in the bag package of the present technology.
Figure 13B:
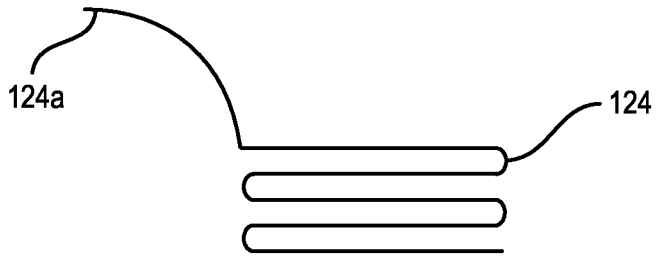
Figure 14:
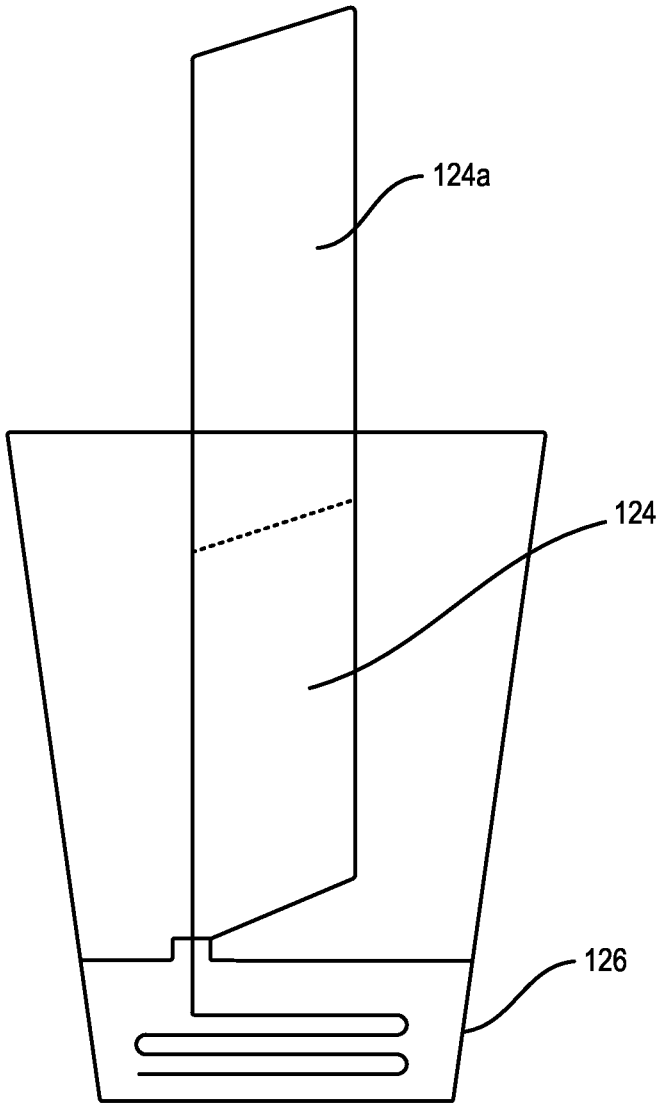
FIG. 14 depicts a side view the bags of a bag package being pulled through a container assembly.
Figure 15:
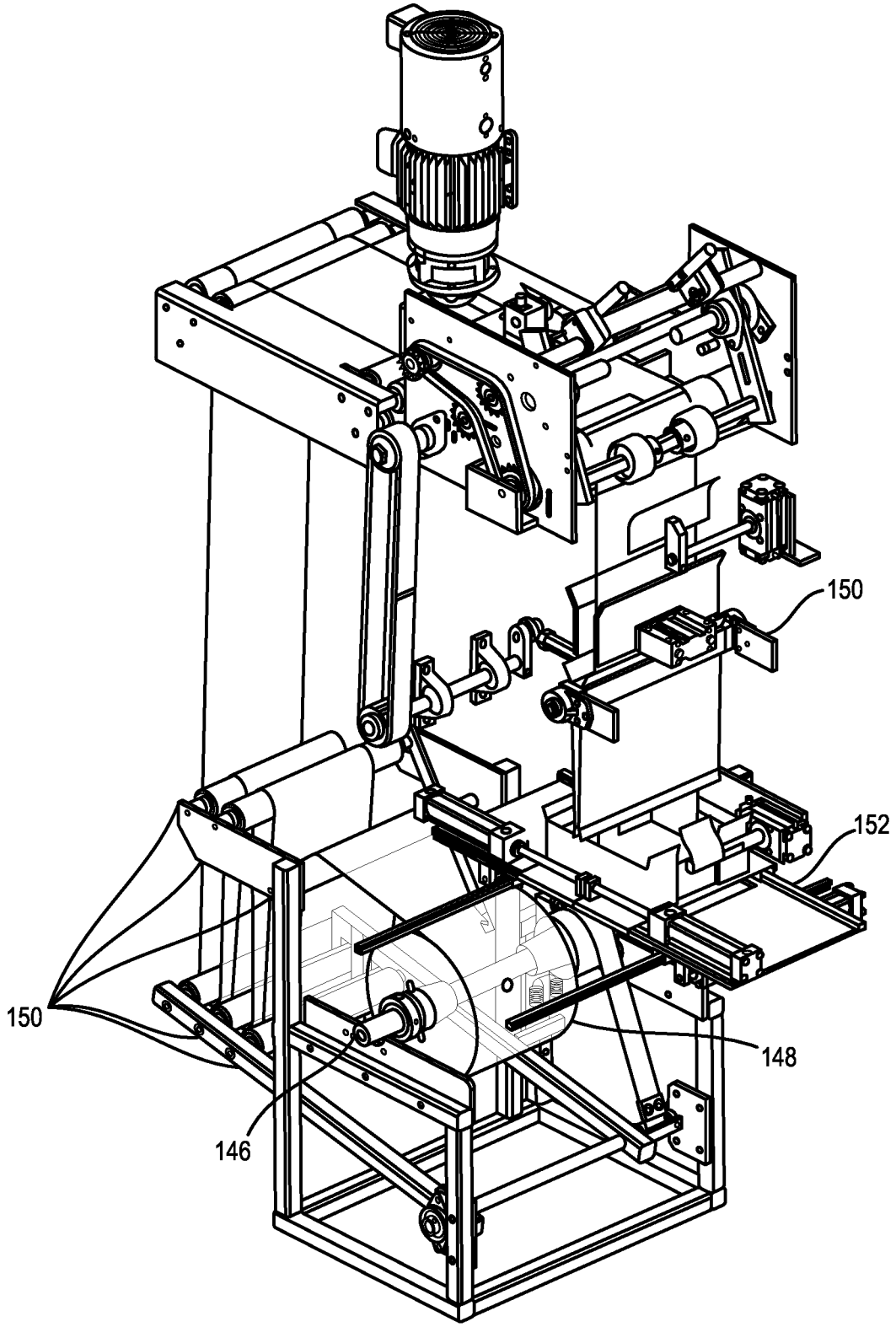
FIG. 15 depicts the manufacturing machine for the bags of the present technology.

The sequentially linked bags 124 of the package 126 are arranged in a zig-zag or fan-fold pattern as shown in FIGS. 13A, 13B and 14 whereby each individual bag 124 is attached to the next via a perforation tear line 142. The sequentially linked bags 124 may be a stack of bags 124 folded to at least partially overlap each other one to the next so that pulling one bag lifts the next bag in sequence. This particular embodiment resembles a stack of tissues contained in a dispensing box having a dispensing slot.

The bags 124 may be made of any appropriate material, including, but not limited, to biodegradable or non-biodegradable materials, including but not limited to, plastic, paper, or fabric.

A plurality of bags 124 can be folded, stacked, acid/or rolled into a package 126. The plurality of bags 124 can be detached from each other, or the plurality bags 124 can be connected in series and torn apart (e.g., along a perforation line between each of bag liners). The package 126 may include an opening through which a single bag 124 can be pulled. The opening of the package 126 can be generally shaped, sized, and positioned such that the opening generally aligns with the container assembly opening 138. Each of the bags 124 can include a tabbed portion to facilitate removal of each bag 124 from the package 126. In an embodiment, the last bag of the package can include an indicator to signal that the package of bags should be replaced. For example, the last bag can be colored, include a message, or otherwise indicate that the package should be replaced.

In some methods of providing bags, a supplier may provide a package of multiple bags to a user of a container assembly, along with instructions to the user to insert the package of multiple bag liners into a bag dispenser on a wall (interior or exterior) of the container assembly such that an opening in the package can be oriented to generally align with the bag-access opening in the wall of the waste container and/or to generally align with a bag-access opening in a wall of an interior container of the container assembly, to facilitate access to the bags within the package from inside of the container assembly.

The sequentially linked bags 124 are manufactured by a process involving a machine 144 including at least one roller feeder 146. The roller feeder 146 and pinch wheel will unwind a roll of perforated bags 148, driving the line of bags 148 throughout the different stations of the machine 144.

The line of bags 148 may be threaded through a series of free-floating and spring-loaded rollers 150 maintaining a constant tension to keep the roll of perforated bags 148 taut. The line of bags 148 may then travel through a spreader assembly 150 having two side walls with a common pivot point activated by a link arm in a fish tail motion to guide the bags into a stacker station 152. Once the line of bags 148 reaches the desired bag count, the drive roller stops, the pinch rollers secure the bag line in place, and two clamp cylinders may hold the other end of the bag line prior to the side walls. Then, a tucker arm may be activated to break the line of bags at a perforated joint.

A stack of continuous bags 124 may be formed in a square bucket assembly, wherein two rotary actuators may clamp the leading edge of the bags to assist in a fan folding formation of the stack. Once the programmed stack accumulation is reached, a transfer cylinder will move the square bucket assembly over to a loading conveyer. At this point, two cylinders may open the bottom walls of the bucket assembly, and the stack of bags may drop into a loading conveyor for transfer to a packaging station. The bottom walls of the bucket assembly may then close and the bucket returns to its home position.

The result is a package 126 of fan folded bags 124 for use in the container assembly 100 or any other type of trash container. In the present container 100, the package 126 may be secured into the dispenser tray 132, a bag 124 may be extended through the opening 138 into the interior of the container assembly 100 when one bag 124 is pulled through the opening 138. The sequential plurality of bags 124 may be a stack of bags fan folded to at least partially overlap each other one to the next so that pulling one bag lifts the next bag in sequence. This particular embodiment resembles a stack of tissues contained in a dispensing box having a dispensing slot and allows a user continually, easy access to one bag at a time as needed. Access to the bag dispenser 118 permits periodic replacement of the package 126 of sequential fan folded bags 124, and allows a first bag in the sequence to once again be pulled through the opening 138.

In an embodiment, the container assembly 100 includes a container partition 154 that generally horizontally divides the container 100 into an upper waste portion 156 and a lower weight sensor portion 158 and includes a weight sensor 160. In an embodiment, the partition 154 may be a panel joined at its perimeter to an internal surface of one or more of the walls 108, 110, 112. In an embodiment, the partition 154 may include intersecting sets of supports, such as wires.

As the bag in the waste chamber 156 collects waste, the bag increases in weight and volume. When the bag reaches a predetermined weight, the sensor 160 located below the waste chamber will emit a signal notifying the user that the liner is full and should be replaced. Preferably, the sensor 160 will emit an RF signal to a receiver located near the top of the waste container having one or more light emitting diodes (LEDs) or other signal device 103. The one or more LEDs 103 may change color based on the signal received from the weight sensor thus notifying the user that the bag should be removed and replaced.

When a filled bag is removed from the container, an integrated cinch or tie 162 can be seen along the upper perimeter of the bag. The integrated cinch 162 can be a bendable wire or a tape-like adhesive that permits the user to tighten the cinch around the open upper edge of the liner for proper disposal.

In an embodiment of the present technology, a motion-activated trigger causes a spray or mist to discharge into the waste chamber from a spray container 105. The spray or mist can be scented or unscented, and can also have antiseptic qualities such as a germ or bacteria killing agent. A movement sensor, preferably located on the edge of the liner passing port, records the movement of the liner when the liner is being replaced. In an embodiment, the container includes a spray canister. The spray canister releases the spray or mist into the waste chamber after receiving a signal from the movement sensor.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The features of each embodiment described and shown herein may be combined with the features of the other embodiments described herein. The claims as follows are intended to include all modifications and alterations insofar as they come within the scope of the claims or the equivalent thereof.

What is claimed is:

1. A container assembly comprising:

a body comprising a first wall, a second wall opposed to the first wall, and lateral side walls connecting the first wall and the second wall;

wherein the second wall comprises an exterior surface, an interior surface, and bag dispenser having a cavity;

wherein the interior surface of the second wall includes a dispenser opening that provides access from the cavity of the bag dispenser to an interior space of the body portion and wherein the dispenser opening is configured to dispense a bag from the cavity of the bag dispenser, through the dispenser opening, and directly into the interior space of the body portion;

wherein the exterior surface of the second wall includes a tray pivotably connected with the second wall that pivots from a closed position to an open position wherein the tray provides access to the cavity of the bag dispenser through a tray opening;

wherein the tray opening is different from the dispenser opening, wherein the tray opening is an exterior access opening sized and shaped to receive a bag package through the tray opening and into the cavity of the bag dispenser while the dispenser opening is an interior access opening sized and shaped to pass a single bag from the cavity of the bag dispenser, through the dispenser opening, and directly into the interior space of the body portion, and wherein the tray opening is larger than the dispenser opening.

2. The container assembly of claim 1, wherein the cavity is configured to hold a plurality of bags.

3. The container assembly of claim 1, wherein the dispenser opening is configured to automatically dispense a next bag in sequence from a bag package when a prior bag is removed from the interior space of the body portion.

* * * * *